US007474269B2

(12) United States Patent
Mayer et al.

(10) Patent No.: US 7,474,269 B2
(45) Date of Patent: Jan. 6, 2009

(54) ANTENNA WITH LOW SAR

(75) Inventors: Cheryl Mayer, Lincoln, NE (US); Xiaotao Liang, Lincoln, NE (US); Saeid Bezian, Lincoln, NE (US); Brian T. Potter, Lincoln, NE (US)

(73) Assignee: Laird Technologies, Inc., Lincoln, NE (US)

( * ) Notice: Subject to any disclaimer, the term of this patent is extended or adjusted under 35 U.S.C. 154(b) by 0 days.

(21) Appl. No.: 11/689,120

(22) Filed: Mar. 21, 2007

(65) Prior Publication Data

US 2008/0231515 A1 Sep. 25, 2008

(51) Int. Cl.
*H01Q 1/24* (2006.01)

(52) U.S. Cl. ..... 343/702; 343/906

(58) Field of Classification Search ..... 343/702, 343/906; 455/575.5, 575.6, 575.7
See application file for complete search history.

(56) References Cited

U.S. PATENT DOCUMENTS 5,835,071 A * 11/1998 Phelps ..... 343/906

* cited by examiner

*Primary Examiner*—Michael C Wimer
(74) *Attorney, Agent, or Firm*—Holland & Hart LLP

(57) ABSTRACT

An antenna having a low specific absorption rate has it power feed connected to radio frequency power such that a connector is arranged between a head of the user and a portion of the power feed.

16 Claims, 3 Drawing Sheets

ANTENNA WITH LOW SAR

CLAIM OF PRIORITY UNDER 35 U.S.C. §119

None.

CLAIM OF PRIORITY UNDER 35 U.S.C. §120

None.

REFERENCE TO CO-PENDING APPLICATIONS FOR PATENT

None.

BACKGROUND

1. Field

The technology of the present invention relates to radio frequency antennas and, and more specifically to radio frequency antennas with a power feed configuration that reduces the specific absorption rate (SAR) of the wireless device.

2. Background

Portable, wireless devices are prevalent in today's society. A person can hardly leave their home without using or encountering the use of a portable, wireless device. For purposes of this application, a portable, wireless device should be construed broadly and includes, but is not limited to, cellular telephones, handheld computers, email devices (such as a BLACKBERRY®), MPEG devices and MP3 players, electronic games, PDAs, and the like.

With the prevalence of wireless devices, many countries are concerned about radio frequency energy or electromagnetic energy being absorbed by a human. SAR is a measurement of the amount of radio frequency energy (radiation) is absorbed by the body when using a radio transmitter such as a cellular telephone. While most electronic devices emit some type of radiation, cellular telephones are of particular interest due to the proximately of the transmitter to the human head during use. For example, referring to FIG. 1, a conventional cellular telephone 100 being used by a user 150 is provided. Cellular telephone 100 includes a printed circuit board (PCB) 102 having radio frequency electronic circuits thereon, not specifically shown, and is coupled to battery 104. Cellular telephone 100 includes an antenna housing 106 containing a radiator 108, shown as a meander trace, but could be other conventional antennas such as, for example, a whip antenna, a helical antenna, or the like. Radio frequency power is provided to radiator 108 from PCB 102 via a feed line 110 and contact 112, which is typically a spring contact, but could be a solder, a press fit, or the like connection. Feed line extends from PCB 102 to radiator 108 along housing 106. Feed line 110 may be a meander line feed or the like. Thus, feed line is, as will be explained in connection with the technology of the present application, relatively close to the head of user 150. While the technology of the present application is specifically discussed with reference to cellular telephones, one of ordinary skill in the art will recognize on reading the disclosure that the technology could be used in any electronic device, including the portable, wireless devices described above.

Currently, the Federal Communication Commission in the United States requires cellular telephones to have a SAR level of about 1.6 watts per kilogram of body tissue (1.6 W/kg) or less. Other countries have similar limits, for example, the European limit for SAR is about 2 W/kg.

Many cellular telephones and other devices include electromagnetic shielding to reduce the amount of radiation emitted by the cellular telephone. While shielding is effective to reduce SAR, it increases the cost, weight, and size of the cellular telephone or other portable, wireless device. Thus, additional mechanisms are desired to further reduce the SAR.

SUMMARY

To attain the advantages and in accordance with the purpose of the invention, as embodied and broadly described herein, an antenna having reduce SAR is provided. A power feed for an antenna on a portable, wireless device is provided. The power feed includes a first portion extending along a first side of a connector to an edge of the connector. A second portion of the power feed is connected to the first portion proximate the first side of the connector and traverses the edge from the first side to a second side of the connector where it is connected to a third portion of the power feed. The third portion extending away from the edge along the second side to a contact, which couples the power feed to a power supply point on the printed circuit board.

The foregoing and other features, utilities and advantages of the invention will be apparent from the following more particular description of a preferred embodiment of the invention as illustrated in the accompanying drawings.

DETAILED DESCRIPTION

The technology of the present invention is described with reference to a conventional stubby antenna connected to a cellular telephone. One of ordinary skill in the art would understand on reading the disclosure that the technology of the present application could be used in numerous electrical devices, such as, for example, desktop, laptop, and portable computers, PDAs, email devices, electronic games, MP3 players, MPEG players, wireless access devices, and the like. However, the technology is most useful where specific absorption rates are of particular concern, such as, for example, cellular telephones.

The word "exemplary" is used herein to mean "serving as an example, instance, or illustration." Any embodiment described herein as "exemplary" is not necessarily to be construed as preferred or advantageous over other embodiments. Moreover, unless specifically described otherwise, all embodiments disclosed herein should be considered exemplary.

Figure 1:
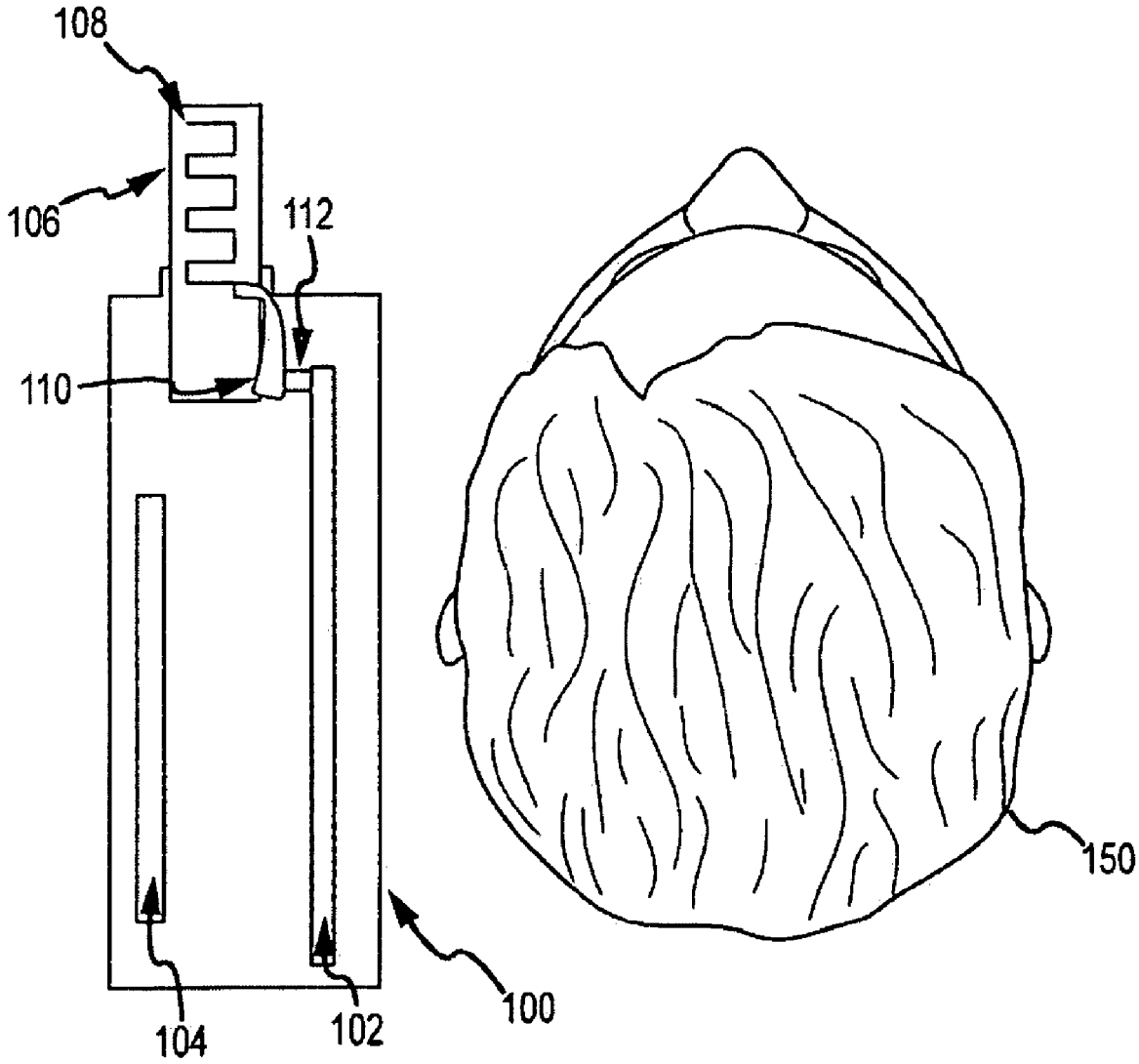
PRIOR ART FIG.1
FIG. 1 is a functional block diagram of a conventional cellular telephone.
Figure 2:
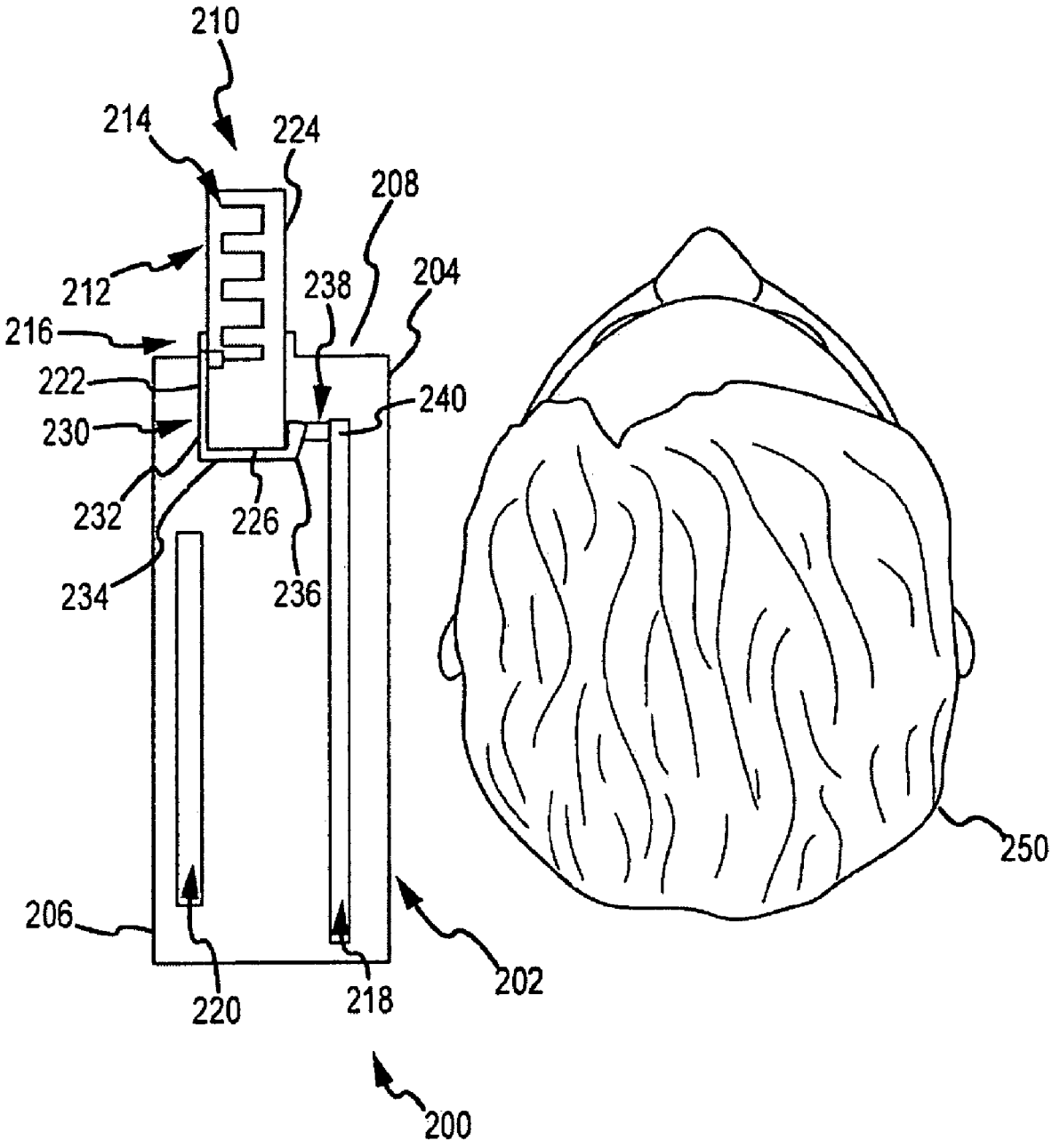
FIG. 2 is a functional block diagram of a portable, wireless device constructed using technology of the present application.

Referring now to FIG. 2, a portable, wireless device 200 is provided proximate a user 250. Portable, wireless device 200 has a housing 202, which in this example is a cellular telephone with a front side 204 and a back side 206. Generally, front side 204 contains a microphone and speaker and would be proximate a head of user 250 whereas back side 206 may contain a slot for a battery pack 220 and is distal the head of the user 250.

Antenna 210 is contained in an antenna housing 212 and has a radiator 214. Antenna 210 is connected to housing 202 by, for example, a connector 216. Connector 216 may be, for example, a snap-fit, a threaded bushing, or the like.

Radiator 214 is connected to radio frequency circuits (not specifically shown) on a PCB 218 internal to housing 202. Radio frequency power is provided to radiator 214 from battery 220 via PCB 218, as will be explained in more detail below.

For reference, connector 216 comprises a first side 222, a second side 224, and at least one edge 226 distal from a top 208 of housing 202. Top 208 simply refers to the side of housing 202 to which antenna 210 is attached and is not provided for any particular orientation. First side 222 of connector 216 is proximate back side 206 of device 200. Second side 224 of connector 216 is proximate front side 204 of device 200. Comparatively, first side 222 is distal front side 204 and second side 224 is distal back side 206.

Radio frequency power is supplied to radiator 214 via a power feed 230. Power feed 230 comprises a first portion 232 connected to radiator 214. First portion 232 meanders along first side 222 of connector 216, distal front side 204 and such that connector 216 is between first portion 232 and user 250. First portion 232 may be separated from first side 222 by a distance D. First portion 232 extends to edge 226. A second portion 234 of power feed 230 extends from first portion 232 to traverse edge 226. In other words second portion 234 wraps around edge 226 and connects to a third portion 236 of power feed 230. Third portion 236 meanders along second side 224 of connector 216 and terminates at contact 238. Contact 238 may be a separate contact or incorporated into power feed 230.

Contact 238 is connected in any connectional manner to a power supply feed point 240 on PCB 218. Battery 220 is connected to PCB 218 in any known conventional manner. Contact 238 may be, for example, a spring contact, a solder point, a press fit contact, or the like.

Figure 3:
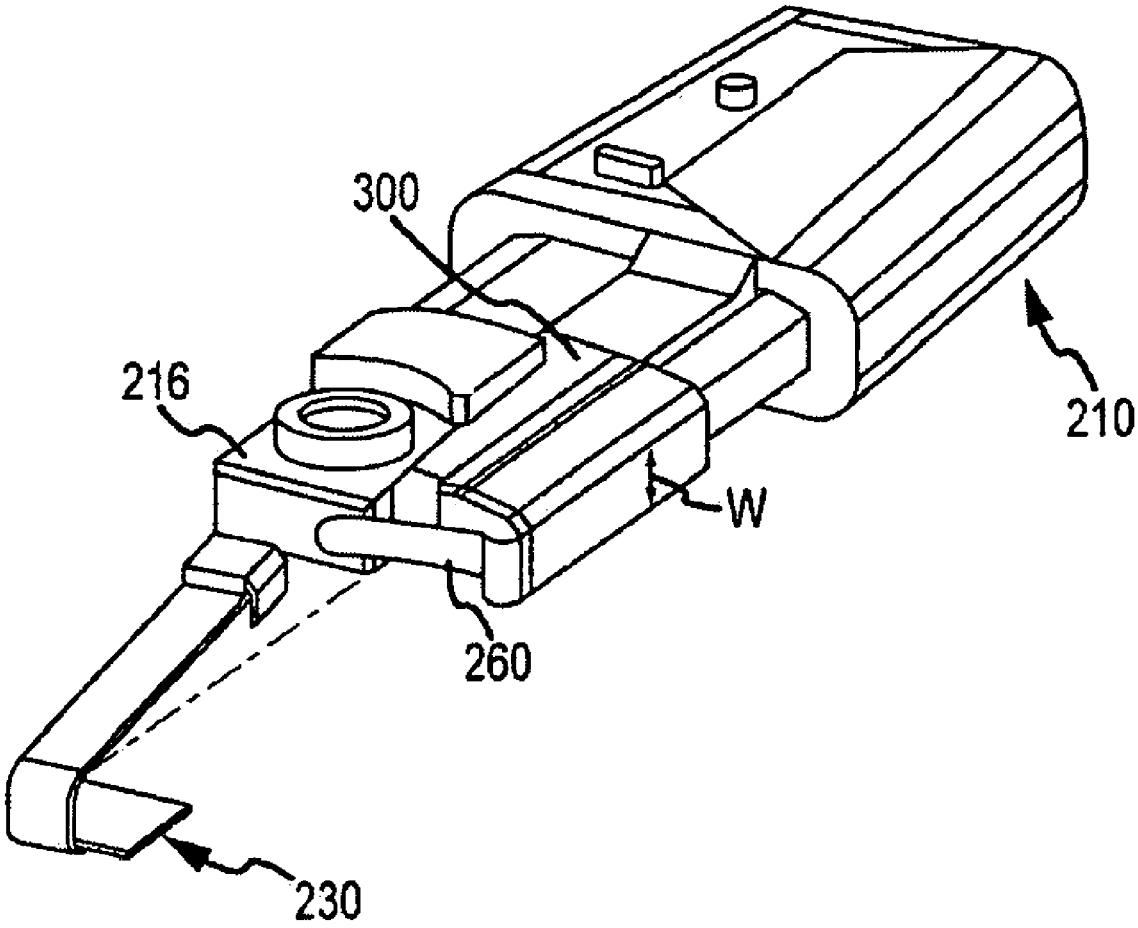
FIG. 3 is an exploded view of the radiator of FIG. 2.

Referring to FIG. 3, a partially exploded view of power feed 230 and connector 216 is provided. As can be seen, connector 216 may be provided with a grove 300 in which power feed 230 resides. Wrapping power feed 230 around connector 216 provides several benefits as will be apparent to those of skill in the art. However, to reduce the SAR, the design creates additional distance between the high current point and the head of any eventual user of the device, whose head would be proximate front side 204. The additional distance is approximately the width W of connector 216. While width W is not often large, radiation diminishes rapidly with distance. Moreover, connector 216 may be formed of a shielding or an insulating material that blocks some of the radiation. The combination of the additional distance and the placement of additional structure between the high current and the head of a user provides a reduction in SAR compared to a comparable portable, wireless device where the power fee contact is typically provided on the connector proximate the head of the user.

To further increase the shielding provided by connector 216, it may be constructed out of an electromagnetic shielding material. Alternatively, or in combination with the material used to construct connector 216, an electromagnetic shield 260 may be formed internal to connector 216. Electromagnetic shield 260 would further reduce the SAR of portable, wireless device 200.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A power feed for an antenna on a portable, wireless device, comprising:

a first portion extending along a first side of a connector to an edge of the connector, the first side of the connector adapted to be proximate a user;

a second portion connected to the first portion proximate the first side of the connector, the second portion traversing the edge from the first side to a second side of the connector;

a third portion connected to the second portion proximate the second side of the connector, the third portion extending away from the edge along the second side, the second side of the connector adapted to be distal the user; and a contact adapted to be distal to the user coupling the third portion to a power feed on a printed circuit board, whereby the power feed is to reduce a specific absorption rate associated with using the portable, wireless device.

2. The power feed according to claim 1, wherein the first portion is separated from the first side of the printed circuit board by a distance.

3. The power feed according to claim 1, wherein the contact is a spring contact.

4. The power feed according to claim 1, wherein the contact is soldered to the second side of the printed circuit board.

5. The power feed according to claim 1, wherein the contact is a press fit contact.

6. The power feed according to claim 1, wherein the first portion meanders along the first side.

7. The power feed according to claim 1, wherein the connector comprises an electromagnetic shield.

8. The power feed according to claim 7, wherein the electromagnetic shield is proximate the first portion.

9. The power feed according to claim 1, wherein the contact is separate and electrically coupled to the third portion.

10. A portable, wireless device including a device housing and an antenna including an antenna housing with a radiating portion contained in the antenna housing, the portable, wireless device comprising:

a connector connecting the antenna housing and the portable, wireless device, the connector having a first side adapted to be proximate a user, a second side adapted to be distal a user, and at least one edge;

a meander line power feed coupled to the antenna proximate a top of the device housing, the meander line comprising:

a first portion, the first portion extending along the first side of the connector to the at least one edge;

a second portion, the second portion connected to the first portion proximate the first side and traversing the at least one edge to the second side;

a third portion, the third portion connected to the second portion proximate the second side, the third portion extending along the second side; and a contact adapted to be distal to the user, the contact coupled to the third portion and a power feed point on a printed circuit board, whereby the power feed is adapted to reduce a specific absorption rate associated with using the portable, wireless device.

11. The portable, wireless device of claim 10, wherein the first portion is separated from the at least one printed circuit, board by a distance.

12. The portable, wireless device according to claim 10, wherein the contact is a spring contact.

13. The portable, wireless device according to claim 10, wherein the contact is soldered to the power feed point.

14. The portable, wireless device according to claim 10, wherein the contact is a press fit contact.

15. The portable, wireless device according to claim 10, wherein the printed circuit board comprises an electromagnetic shield.

16. The portable, wireless device according to claim 10, wherein the connector comprises a groove to receive the power feed.

* * * * *